US008181823B2

(12) United States Patent
Fukuizumi et al.

(10) Patent No.: US 8,181,823 B2
(45) Date of Patent: May 22, 2012

(54) POUCH AND METHOD OF PRODUCING POUCH CONTAINER WITH SPOUT

(75) Inventors: Takashi Fukuizumi, Osaka (JP); Shinichiro Furuse, Sakai (JP); Kazuya Takagi, Osaka (JP); Osao Ueda, Osaka (JP)

(73) Assignee: Fuji Seal International, Inc., Osaka-shi (JP)

( * ) Notice: Subject to any disclaimer, the term of this patent is extended or adjusted under 35 U.S.C. 154(b) by 659 days.

(21) Appl. No.: 11/578,510

(22) PCT Filed: Apr. 15, 2005

(86) PCT No.: PCT/JP2005/007329

§ 371 (c)(1), (2), (4) Date: May 25, 2007

(87) PCT Pub. No.: WO2005/102855

PCT Pub. Date: Nov. 3, 2005

(65) Prior Publication Data

US 2007/0257047 A1 Nov. 8, 2007

(30) Foreign Application Priority Data

Apr. 19, 2004 (JP) ..... 2004-122927

(51) Int. Cl.
*B65D 35/00* (2006.01)

(52) U.S. Cl. ..... 222/107; 206/484; 383/80

(58) Field of Classification Search ..... 222/107, 222/92, 206, 207, 215; 383/80, 201.1; 141/2, 141/18, 10, 313–316; 493/213, 916, 923, 493/927; 206/484, 432

See application file for complete search history.

(56) References Cited

U.S. PATENT DOCUMENTS

| | | | | |
|---|---|---|---|---|
| 6,244,747 | B1 * | 6/2001 | Caudle | 383/200 |
| 6,854,888 | B1 * | 2/2005 | Brown et al. | 383/80 |
| 2001/0015056 | A1 * | 8/2001 | Hiramoto et al. | 53/479 |
| 2003/0029884 | A1 * | 2/2003 | Rau | 222/92 |

FOREIGN PATENT DOCUMENTS

| | | | | |
|---|---|---|---|---|
| JP | 6-48401 | A | 2/1994 | |
| JP | 7-41014 | * | 2/1995 | 222/107 |
| JP | 10-236490 | * | 9/1998 | 222/107 |
| JP | 10-324349 | * | 12/1998 | 383/80 |

(Continued)

*Primary Examiner* — Lien T Ngo

(74) *Attorney, Agent, or Firm* — Westerman, Hattori, Daniels & Adrian, LLP

(57) ABSTRACT

A pouch and a production method for a spout pouch container are provided, which suppress curling of an opened spout attachment edge portion and offset of a filling port defining edge portion adjacent to the spout attachment edge portion when a spout is heat-sealed to the spout attachment edge portion. The pouch (10) is of a bottom gusset type, which includes a pair of front and rear exterior sheets (11, 12) and a gusset sheet (13) folded inward from lower portions of the exterior sheets (11, 12) to define a bottom gusset portion. When a spout (20) is attached to the pouch (10), a spout attachment edge portion (10A) and a filling port defining edge portion (10B) disposed adjacent the spout attachment edge portion (10A) and defining a filling port through which a liquid product is filled as content in the pouch are unsealed, but a spot-seal portion (PS) formed by partly heat-sealing the pouch is disposed in a region around a boundary between the spout attachment edge portion (10A) and the filling port defining edge portion (10B).

3 Claims, 11 Drawing Sheets

FOREIGN PATENT DOCUMENTS

| | | | | |
|---|---|---|---|---|
| JP | 11-11496 | * | 1/1999 | 222/107 |
| JP | 11-255250 | * | 9/1999 | 383/80 |
| JP | 11-314644 | * | 11/1999 | 383/80 |
| JP | 2000-25797 | * | 1/2000 | 222/107 |
| JP | 2000-302141 | * | 10/2000 | 383/80 |
| JP | 2001-278361 A | | 10/2001 | |
| JP | 2002-326641 | * | 11/2002 | 222/107 |
| JP | 2003-40292 | * | 2/2003 | 222/107 |
| JP | 2004-43032 | * | 2/2004 | 222/107 |
| WO | WO-2004/108545 | * | 12/2004 | 383/80 |

* cited by examiner

PRIOR ART

PRIOR ART

POUCH AND METHOD OF PRODUCING POUCH CONTAINER WITH SPOUT

TECHNICAL FIELD

The present invention relates to a pouch to be used for production of a spout pouch container which contains, for example, a liquid product such as a shampoo or a rinse to be refilled in a bottle container, and to a production method for such a spout pouch container.

BACKGROUND ART

As a pouch container for containing a liquid product such as a shampoo to be refilled in a bottle container, for example, a spout pouch container 50 as shown in FIG. 9A is used, which includes a spout 52 attached to a pouch 51 formed of flexible sheets. The spout pouch container 50 is designed, as shown in FIG. 9B, so that a filling port M through which the liquid product is filled as content in the pouch is provided in the vicinity of spout attachment edge portions 51A to which the spout 52 is heat-sealed and, after the filling of the content, filling port defining edge portions 51B defining the filling port M are heat-sealed to close the filling port M.

For production of the spout pouch container 50, the pouch 51 is first produced by heat-sealing peripheral edges of the sheets except for the spout attachment edge portions 51A and the filling port defining edge portions 51B as shown in FIG. 10. Then, as shown in FIG. 11A, an opening is formed between the spout attachment edge portions 51A, and an attachment portion 52*a* of the spout 52 is inserted into the opening. In turn, as shown in FIG. 11B, the spout attachment edge portions 51A are held between a pair of seal bars SB so as to be heat-pressed. Thus, the attachment portion 52*a* of the spout 52 is heat-sealed to the spout attachment edge portions 51A of the pouch 51 as shown in FIG. 1C. A hatched portion in FIG. 10 indicates a heat-sealed region.

Patent Document 1: Japanese Unexamined Patent Publication No. HEI6(1994)-48401

DISCLOSURE OF THE INVENTION

Problems to be Solved by the Invention

However, when the spout 52 which has a relatively great thickness is heat-sealed to the spout attachment edge portions 51A, the filling port defining edge portions 51B unsealed at this stage are liable to be offset from each other as shown in FIG. 12, thereby deteriorating the appearance of the spout pouch container 50. Particularly where the content has a higher viscosity, the spout 52 has a greater diameter and hence the attachment portion 52*a* has a greater thickness. This aggravates the offset of the filling port defining edge portions 51B.

When the attachment portion 52*a* of the spout 52 is heat-sealed to the spout attachment edge portions 51A, an opening is formed between the spout attachment edge portions 51A by sucking and holding the spout attachment edge portions 51A by means of a pair of suction pads and moving the suction pads away from each other, and the attachment portion 52*a* of the spout 52 is inserted into the opening. However, when the opening is formed between the spout attachment edge portions 51A in the pouch 51 in which the spout attachment edge portions 51A and the filling port defining edge portions 51B disposed adjacent each other are unsealed at this stage, the spout attachment edge portions 51A are liable to be curled inward depending on the laminate structure of the laminate sheets of the pouch 51. This makes it difficult to insert the attachment portion 52*a* of the spout 52 into the opening.

It is therefore an object of the present invention to provide a pouch and a production method for a spout pouch container which suppress the curling of an opened spout attachment edge portion and the offset of a filling port defining edge portion adjacent to the spout attachment edge portion when a spout is heat-sealed to the spout attachment edge portion.

MEANS FOR SOLVING THE PROBLEMS

According to an inventive aspect of the claimed invention to solve the aforesaid problems, there is provided a pouch for production of a spout pouch container, the pouch comprising a spout attachment edge portion to be heat-sealed with a spout being held therein, a filling port defining edge portion provided adjacent the spout attachment edge portion and defining a filling port through which content is filled in the pouch, and a spot-seal portion provided in a region around a boundary between the spout attachment edge portion and the filling port defining edge portion.

According to an inventive aspect of the claims to solve the aforesaid problems, there is provided a production method for a spout pouch container which includes a spout, and a pouch having a spout attachment edge portion heat-sealed with the spout being held therein and a filling port defining edge portion which is disposed adjacent the spout attachment edge portion and defines a filling port to be sealed by heat-sealing after content is filled in the pouch, the method comprising the steps of: spot-sealing a region around a boundary between the spout attachment edge portion and the filling port defining edge portion of the pouch which is produced in advance or spot-sealing a region around a boundary between a portion later serving as the spout attachment edge portion and a portion later serving as the filling port defining edge portion in a pouch production process; and attaching the spout to the spout attachment edge portion of the pouch.

EFFECTS OF THE INVENTION

In the pouch as described above, the spot-seal portion is provided in the region around the boundary between the spout attachment edge portion and the filling port defining edge portion disposed adjacent each other. Therefore, when the spout is heat-sealed to the spout attachment edge portion, the spout attachment edge portion in an opened state is less liable to be curled, so that the spout can be easily inserted into the spout attachment edge portion. In addition, the filling port defining edge portion adjacent to the spout attachment edge portion is free from offset, so that the spout pouch container filled with the content can be neatly finished.

In the production method for the spout pouch container, the region around the boundary between the spout attachment edge portion and the filling port defining edge portion of the pouch which is produced in advance is spot-sealed or the region around the boundary between the portion later serving as the spout attachment edge portion and the portion later serving as the filling port defining edge portion is spot-sealed in the pouch production process before the spout is attached to the spout attachment edge portion of the pouch. Therefore, when the spout is heat-sealed to the spout attachment edge portion of the pouch, the spout attachment edge portion in an opened state is less liable to be curled, so that the spout can be easily inserted into the spout attachment edge portion. In addition, the filling port defining edge portion adjacent to the spout attachment edge portion is less liable to be offset, so that the spout pouch container filled with the content can be neatly finished.

DESCRIPTION OF REFERENCE CHARACTERS

Figure 1:
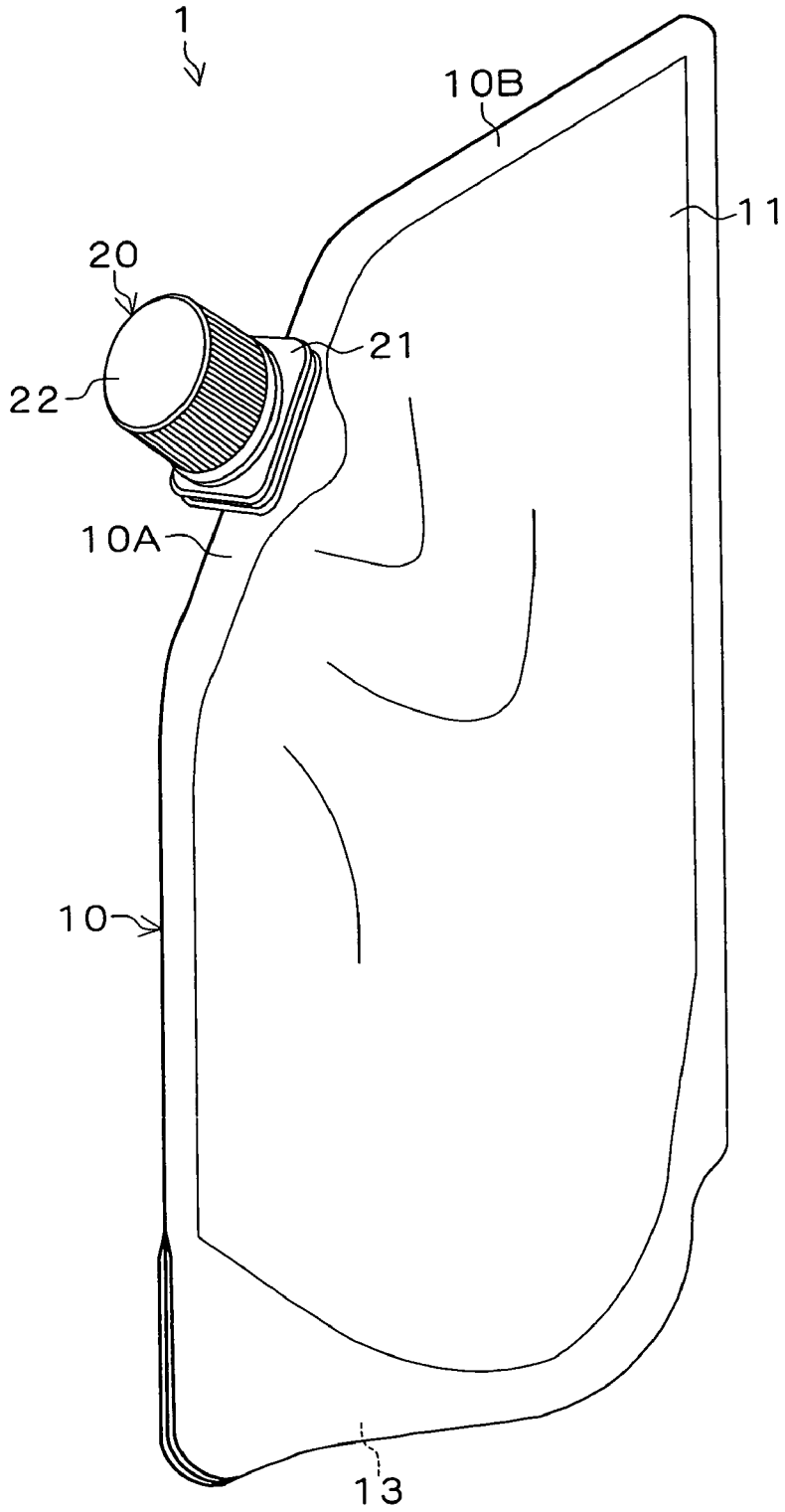
FIG. 1 is a perspective view illustrating a spout pouch container according to one embodiment of the present invention.

1: Spout pouch container
10: Pouch
10A: Spout attachment edge portion
10B: Filling port defining edge portion
11, 12: Exterior sheets
13: Gusset sheet
13*a*: Cut-away portions
20: Spout
21: Spout body
22: Screw cap
23: Attachment portion
PS: Spot-seal portion
S1,S2,S3: Flexible sheets
SB: Seal bars

BEST MODE FOR CARRYING OUT THE INVENTION

Figure 2:
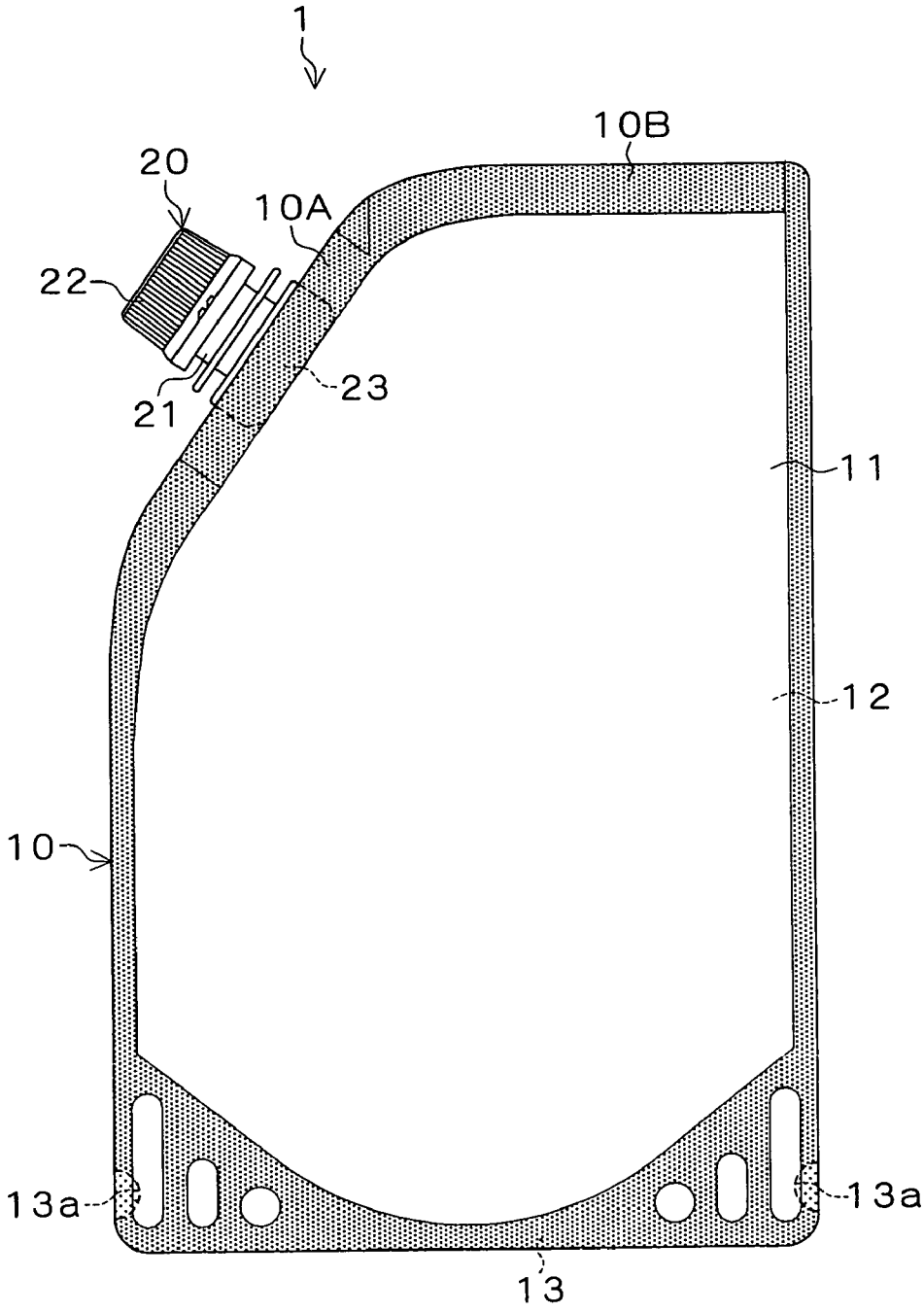
FIG. 2 is a side view illustrating the spout pouch container.

Embodiments will hereinafter be described with reference to the drawings. As shown in FIGS. 1 and 2, a spout pouch container 1 is adapted to contain a liquid product such as a shampoo or a rinse to be refilled in a pump bottle container, and includes a flatly foldable pouch 10 and a spout 20 attached to the pouch 10, the pouch 10 being formed of a flexible sheet having a thickness of 100 to 150 μm, and including a thermally-bondable sealant film such as of polyethylene or polypropylene and a biaxially drawn polyester film provided on an outer surface of the sealant film and laminated with a gas barrier sheet such as of aluminum, the spout 20 being composed of the same heat-bondable resin as used as a material for the sealant film of the flexible sheet.

As shown in FIG. 2, the pouch 10 includes a pair of front and rear exterior sheets 11, 12 and a gusset sheet 13 folded inward from lower portions of the exterior sheets 11, 12 with a sealant surface thereof being opposed sealant surfaces of the exterior sheets 11, 12 to define a bottom gusset portion. Peripheral edge portions of the inner surfaces (sealant film surfaces) of the exterior sheets 11, 12 are heat-sealed to each other, and a peripheral edge portion of the inner surface (sealant film surface) of the folded gusset sheet 13 is heat-sealed to the inner surfaces of the exterior sheets 11, 12, whereby the pouch is provided. The gusset sheet 13 has cut-away portions 13*a* provided in each of opposite side edges thereof, so that the cut-away portions 13*a* coincide with each other with the gusset sheet 13 being doubly folded. Through the cut-away portions 13*a*, the lower portions of the exterior sheets 11, 12 are partly heat-sealed to each other on opposite side edges. In FIG. 2, the heat-sealed portions of the pouch 10 are hatched.

The external sheets 11, 12 of the pouch 10 each have a generally pentagonal shape such as obtained by cutting one upper corner portion of a rectangle. The spout 20 is attached to an inclined spout attachment edge portion 10A of the pouch 10. At the stage of the attachment of the spout 20, the spout attachment edge portion 10A and a filling port defining edge portion 10B disposed adjacent the spout attachment edge portion 10A and later defining a filling port through which the liquid product is filled as content in the pouch are unsealed, but a spot-seal portion PS formed by partly heat-sealing the pouch is disposed in a region around a boundary between the spout attachment edge portion 10A and the filling port defining edge portion 10B as shown in FIG. 3.

Figure 3:
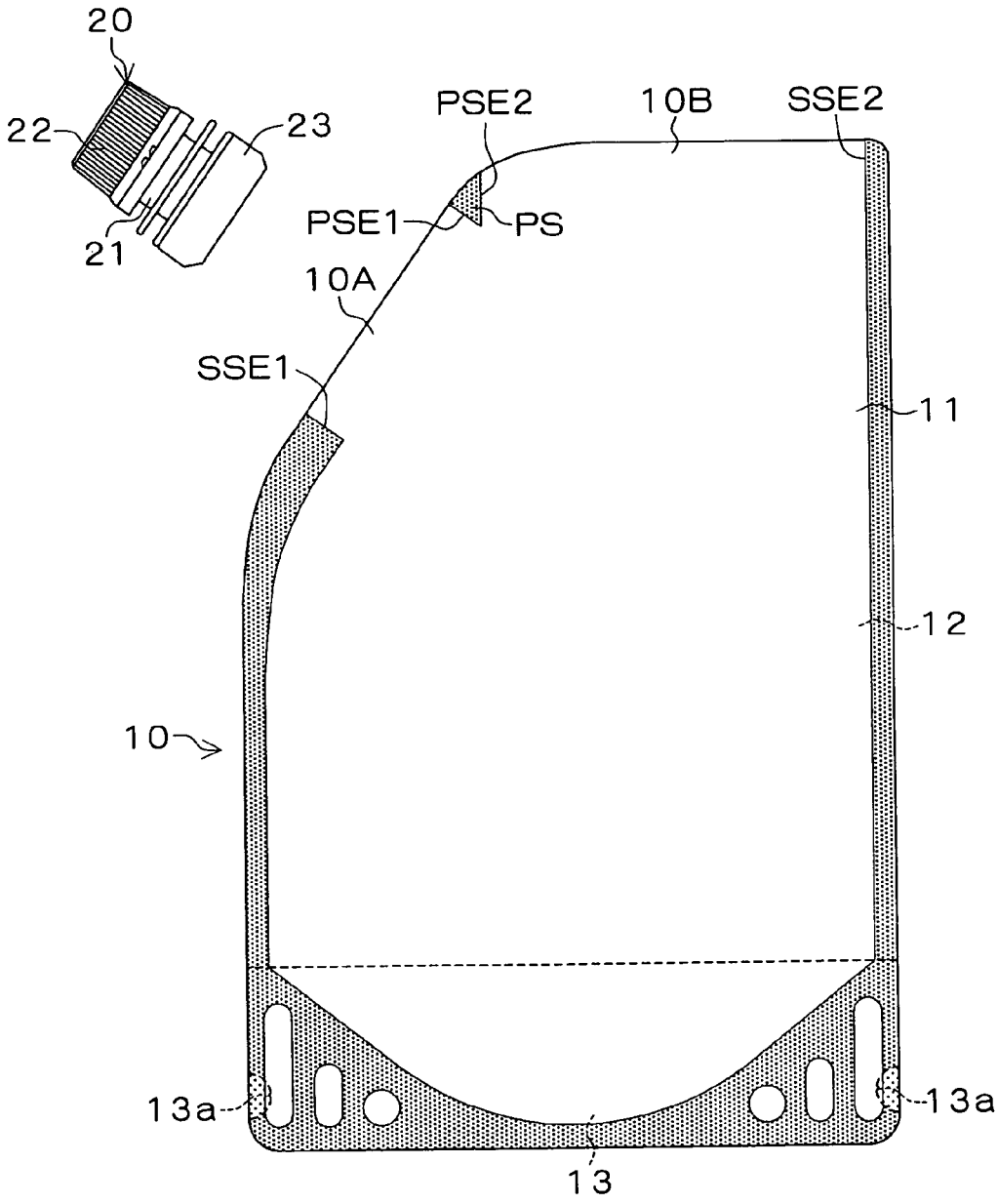
FIG. 3 is a side view illustrating a pouch and a spout to be used for the spout pouch container.

As shown in FIG. 3, the spout 20 includes a spout body 21 through which the liquid product filled in the pouch 10 is poured out, a screw cap 22 for closing and opening the spout body 21, and an attachment portion 23 continuous to the spout body 21 and having a boat-like sectional shape or an oval sectional shape (having a relatively great thickness on the order of 15 to 25 mm) The attachment portion 23 is held in the spout attachment edge portion 10A of the pouch 10 and heat-sealed to the spout attachment edge portion 10A.

Figure 4A:
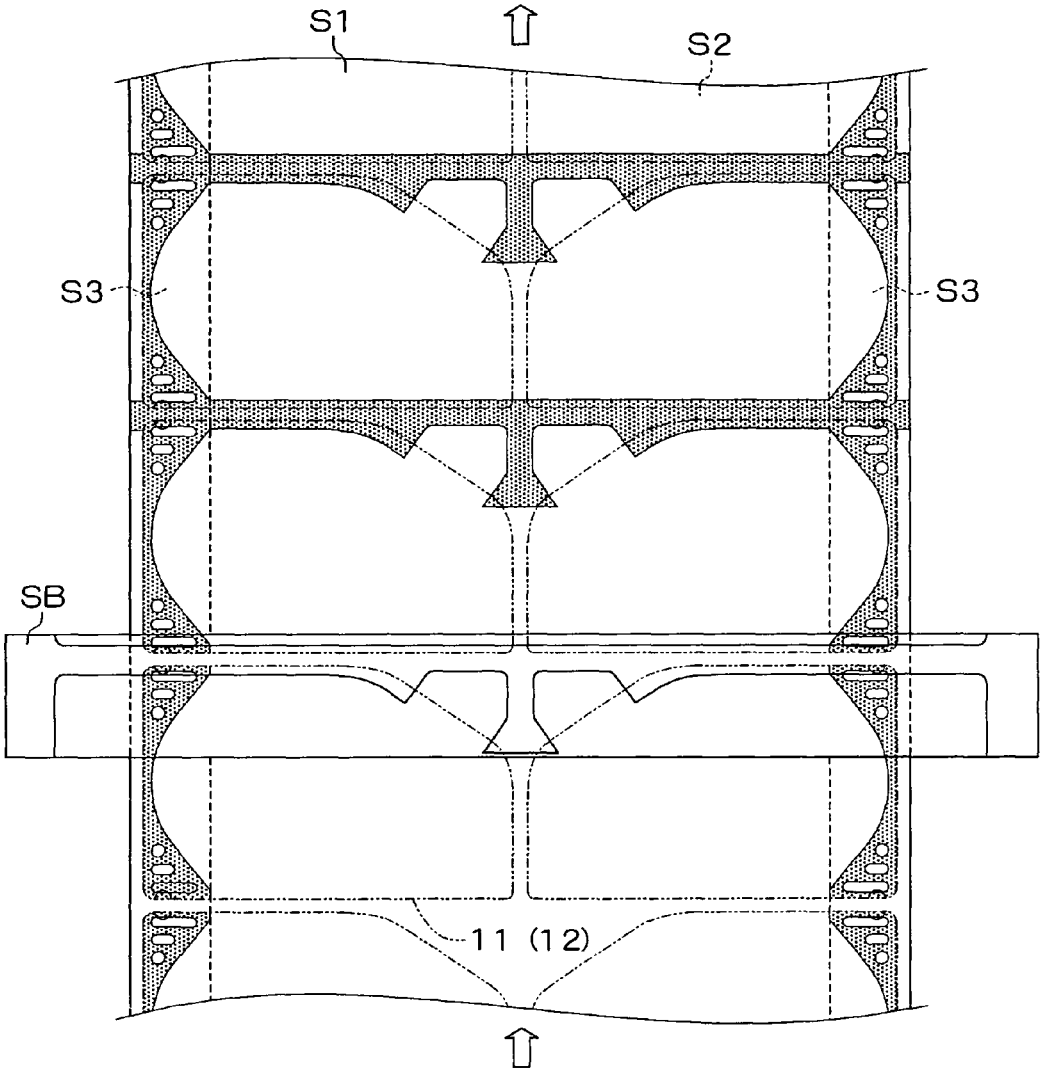
FIGS. 4A and 4B are explanatory diagrams for explaining a production method for the pouch.
Figure 4B:
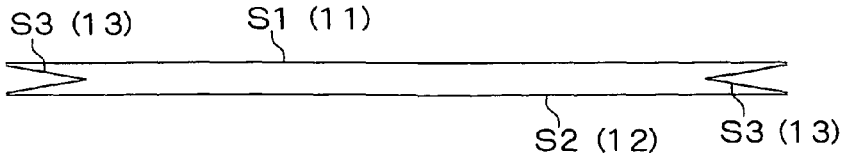

The spout pouch container 1 having the aforesaid construction is produced in the following manner. As shown in FIGS. 4A and 4B, two elongated flexible sheets S1, S2 later serving as the external sheets 11, 12 are stacked and transported in such a state that elongated flexible sheets S3 each later serving as the gusset sheet 13 are folded to be held between the flexible sheets S1 and S2 on laterally opposite sides, and portions of the flexible sheets S3 each later serving as the peripheral edge portion of the gusset sheet 13 are sequentially heat-sealed to portions of the flexible sheets S1, S2 later serving as the exterior sheets 11, 12 on an upstream side of a seal bar SB. In FIG. 4A, portions of the flexible sheets later serving as the exterior sheets 11, 12 are surrounded by two-dot-and-dash lines, and heat-sealed portions are hatched.

In turn, as shown in FIG. 4A, side edges of upstream exterior sheet portions 11, 12 on the side of the spout attachment edge portion 10A and side edges of downstream exterior sheet portions 11, 12 which are disposed adjacent each other in the transport direction of the flexible sheets S1, S2, S3 are heat-sealed by the seal bar SB. At this time, the side edges of the downstream exterior sheet portions 11, 12 are heat-sealed along their entire lengths, while the side edges of the upstream exterior sheet portions 11, 12 are partly heat-sealed except for the spout attachment edge portion 10A. That is, parts of the side edges of the upstream exterior sheet portions 11, 12 extending from a lower portion of an inclined edge portion to the gusset sheet portion 13 and the spot-seal portion PS are heat-sealed. The side edges on the side of the spout attachment edge portion 10A are heat-sealed in the first heat-sealing step, and the side edges on the opposite side are heat-sealed in the second heat-sealing step.

After the heat-sealing of the opposite side edges of the exterior sheet portions 11, 12 is thus completed, the exterior sheet portions 11, 12 indicated by the two-dot-and-dash line in FIG. 4A are stamped out. Thus, the pouch 10 is produced, in which the spout attachment edge portion 10A and the filling port defining edge portion 10B adjacent to the spout attachment edge portion 10A are not heat-sealed and the spot-seal portion PS is provided in the region around the boundary between the spout attachment edge portion 10A and the filling port defining edge portion 10B as shown in FIG. 3.

Figure 5B:
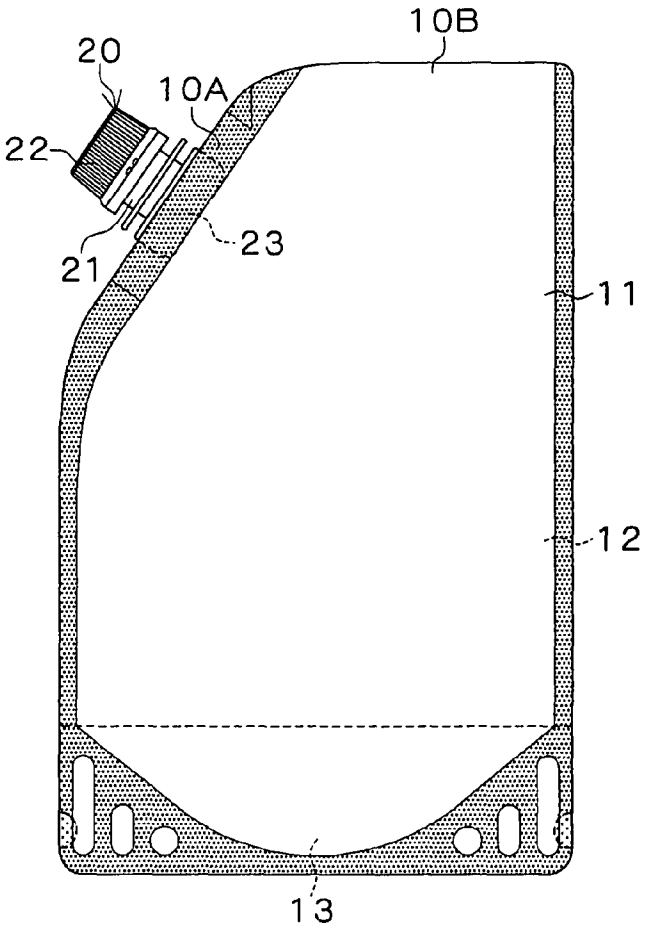
FIGS. 5A and 5B are explanatory diagrams for explaining a production method for the spout pouch container.
Figure 5A:
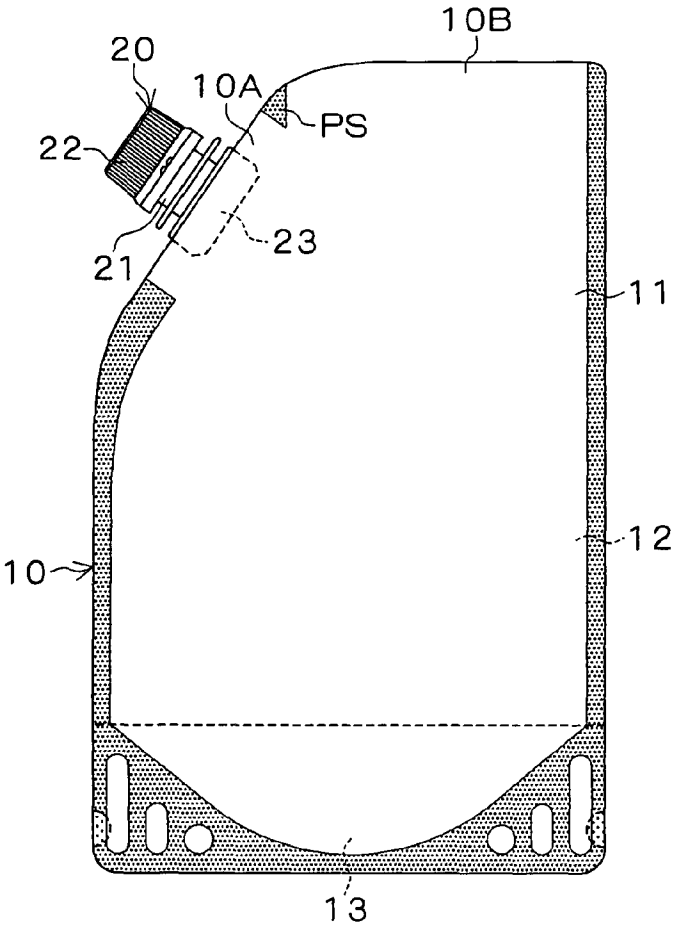

After the spout attachment edge portion 10A of the pouch 10 thus produced is opened and the attachment portion 23 of the spout 20 is inserted into the opened spout attachment edge portion 10A as shown in FIG. 5A, the attachment portion 23 of the spout 20 is heat-sealed to the spout attachment edge portion 10A. Thus, the spout 20 is attached to the pouch 10.

Finally, the liquid product is filled as the content in the pouch through the filling port defined by the unsealed filling port defining edge portion 10B, and then the filling port defining edge portion 10B is heat-sealed, whereby the liquid product is sealed in the pouch 10. Thus, the spout pouch container 1 filled with the liquid product is produced as shown in FIGS. 1 and 2.

As described above, the spout pouch container 1 employs the pouch 10 in which the spot-seal portion is provided in the region around the boundary between the spout attachment edge portion 10A and the filling port defining edge portion 10B disposed adjacent each other. Therefore, the opened spout attachment edge portion 10A is less liable to be curled inward, so that the attachment portion 23 of the spout 20 can be smoothly and assuredly inserted into the opened spout attachment edge portion 10A. When the attachment portion 23 of the spout 20 is heat-sealed to the spout attachment edge portion 10A, the filling port defining edge portion 10B adjacent to the spout attachment edge portion 10A is free from offset, so that the spout pouch container 1 filled with the liquid product can be neatly finished.

In the embodiment described above, the spout attachment edge portion 10A of the pouch is inclined, but this arrangement is not limitative. As long as the spout attachment edge portion and the filling port defining edge portion are disposed adjacent each other, the present invention is applicable to a pouch arranged so that the spout is attached to a side edge of an upper corner of generally rectangular exterior sheets and the content is filled in the pouch from an unsealed upper edge portion.

Figure 6B:
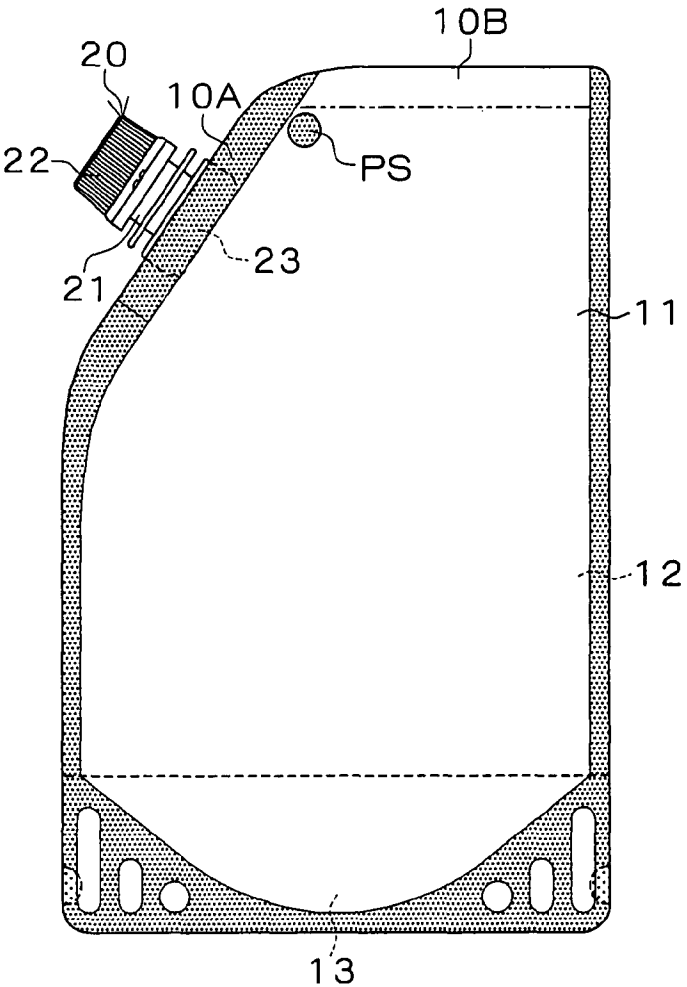
FIGS. 6A and 6B are side views illustrating spout pouch containers each having a spot-seal portion provided at a different position after attachment of a spout according to other embodiments.
Figure 6A:
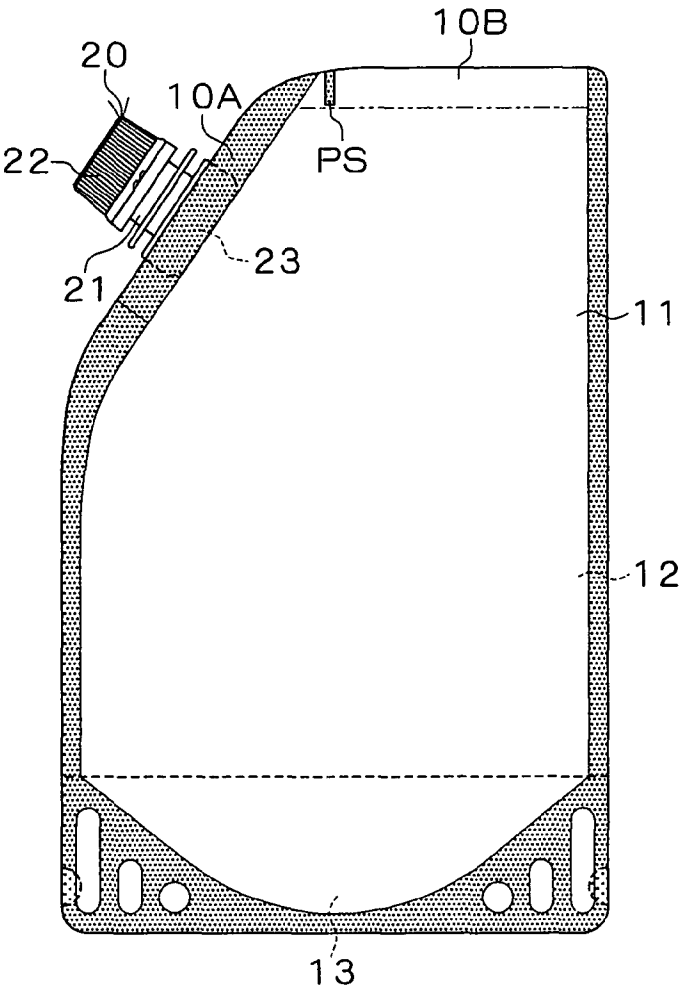

In the embodiment described above, the spot-seal portion PS is provided on one end of the spout attachment edge portion 10A (adjacent to the filling port defining edge portion 10B) to be heat-sealed as shown in FIG. 5B, but this arrangement is not limitative. For example, the spot-seal portion PS may be provided on one end of the filling port defining edge portion 10B (adjacent to the spout attachment edge portion 10A) as shown in FIG. 6A. Alternatively, the spot-seal portion PS may be provided outside the spout attachment edge portion 10A to be heat-sealed when the spout is attached and the filling port defining edge portion 10B to be heat-sealed after the filling of the content as shown in FIG. 6B. In FIGS. 6A and 6B, an inner edge of a heat-seal region in the filling port defining edge portion 10B to be heat-sealed after the filling of the content is indicated by two-dot-and-dash lines.

Figure 7B:
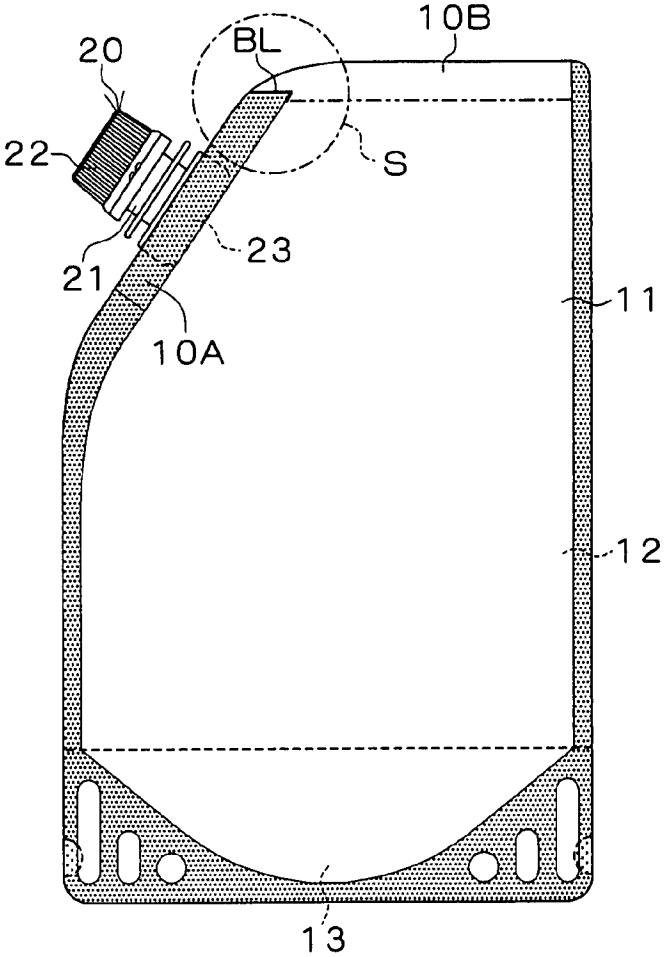
FIGS. 7A and 7B are explanatory diagrams for explaining the expression "a region around a boundary between a spout attachment edge portion and a filling port defining edge portion.
Figure 7A:
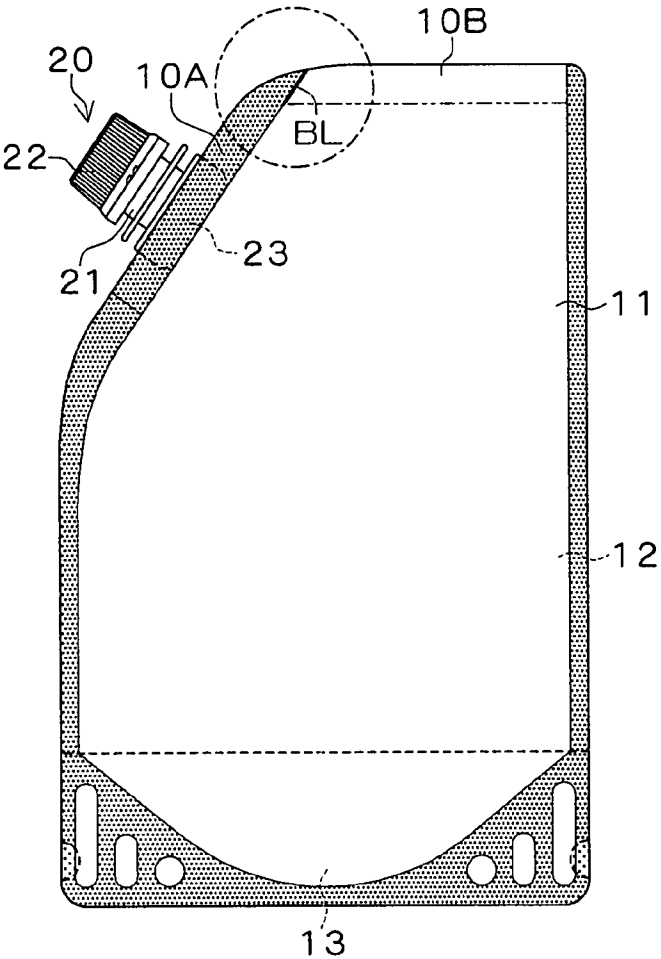

The expression "the boundary between the spout attachment edge portion 10A and the filling port defining edge portion 10B" means a boundary BL between the heat-sealed spout attachment edge portion 10A and the filling port defining edge portion 10B unsealed during the filling of the content but heat-sealed after the filling of the content as shown in FIGS. 7A and 7B. This means that "the boundary BL between the spout attachment edge portion 10A and the filling port defining edge portion 10B" differs depending on how to heat-seal the spout attachment edge portion 10A to attach the spout. The expression "the region around the boundary between the spout attachment edge portion 10A and the filling port defining edge portion 10B" means a circular region S generally centering on the boundary BL between the spout attachment edge portion 10A and the filling port defining edge portion 10B and having a radius of 15 mm, preferably 10 mm. At least a part of the spot-seal portion PS may be formed within this region. In FIGS. 7A and 7B, the inner edge of the heat-seal region in the filling port defining edge portion 10B to be heat-sealed after the filling of the content is indicated by two-dot-and-dash lines.

Figure 8:
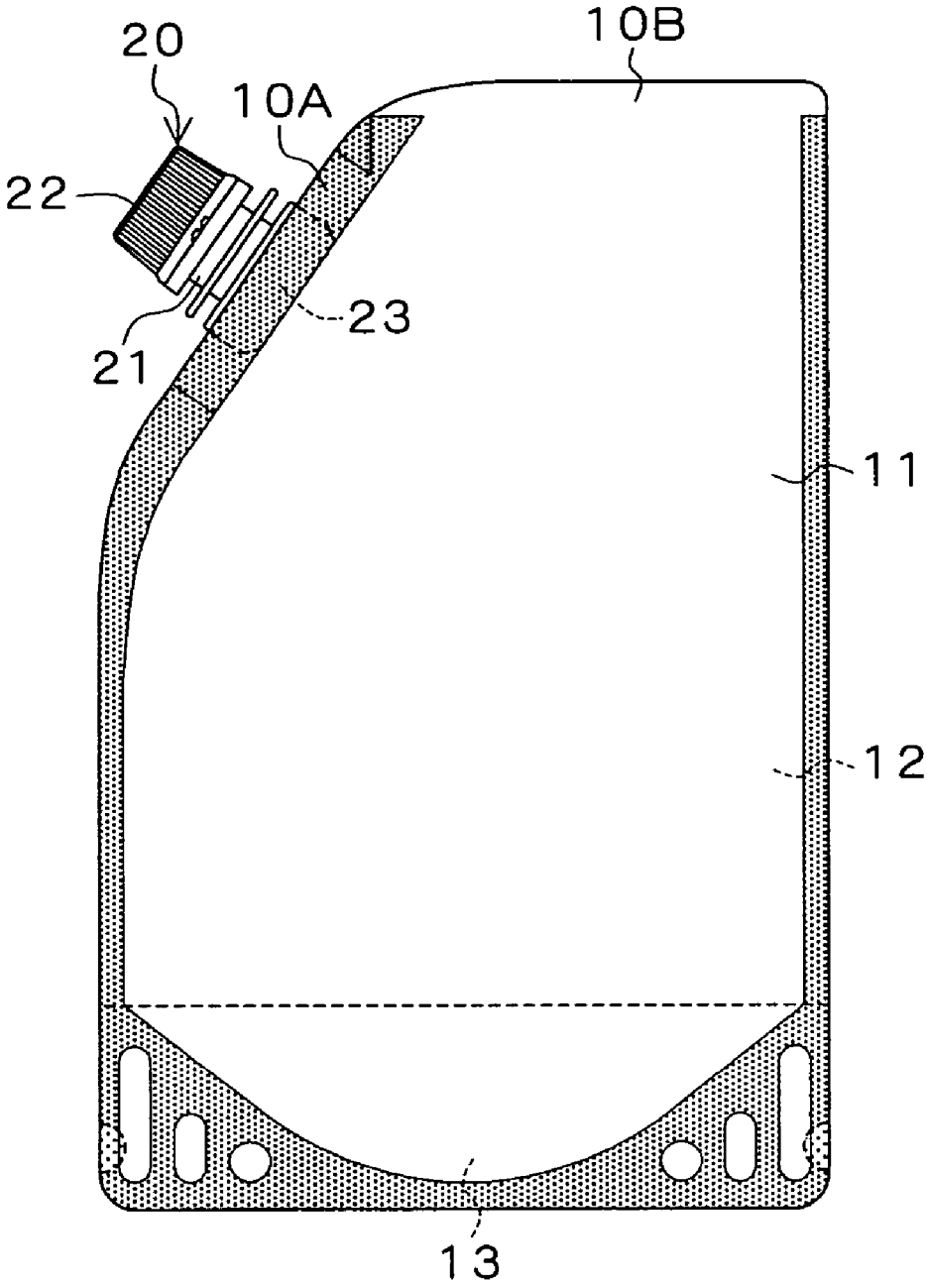
FIG. 8 is a side view illustrating a spout pouch container arranged to improve the openability of a content filling port thereof according a modification.
Figure 9A:
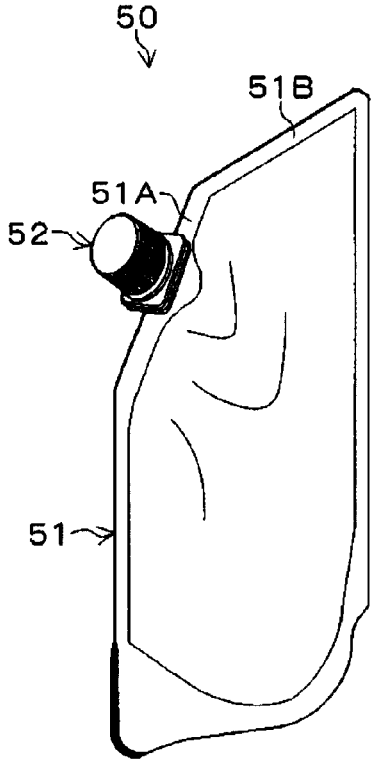
Fig. 9A PRIOR ART
FIG. 9A is a perspective view illustrating a prior art spout pouch container.
Figure 9B:
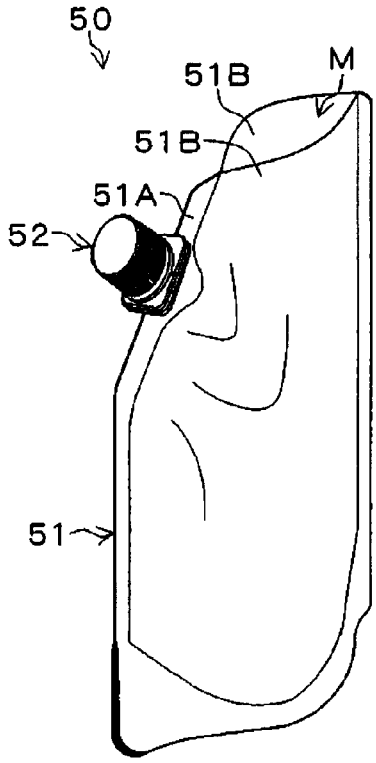
Fig. 9B PRIOR ART
FIG. 9B is a perspective view illustrating how to fill the spout pouch container with content.
Figure 10:
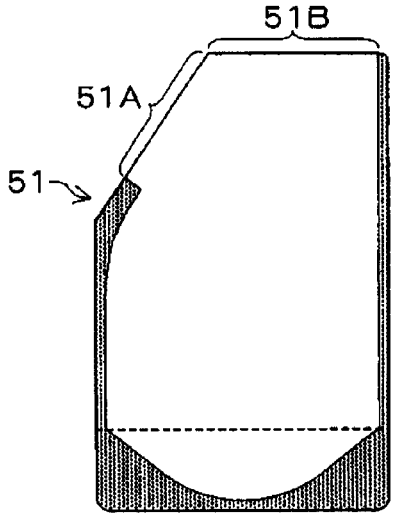
FIG. 10 is a side view illustrating a pouch to be used for the spout pouch container.
Figure 11A:
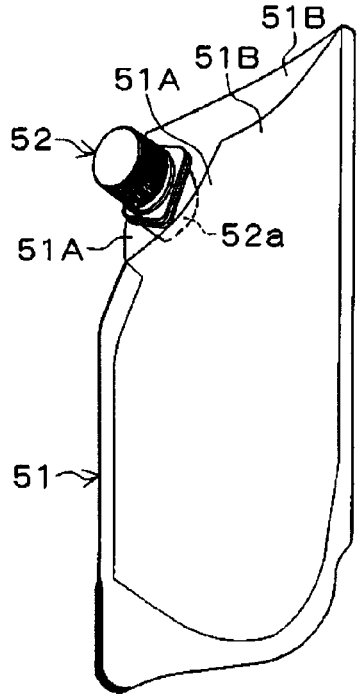
Fig. 11A PRIOR ART
FIGS. 11A to 11C are perspective views illustrating how to attach a spout to the pouch.
Figure 11B:
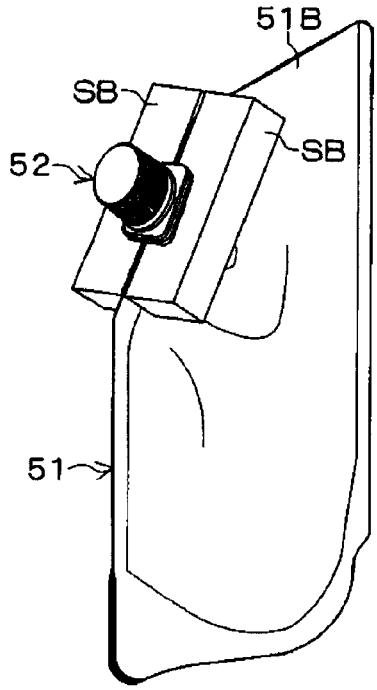
Fig. 11B PRIOR ART
Figure 11C:
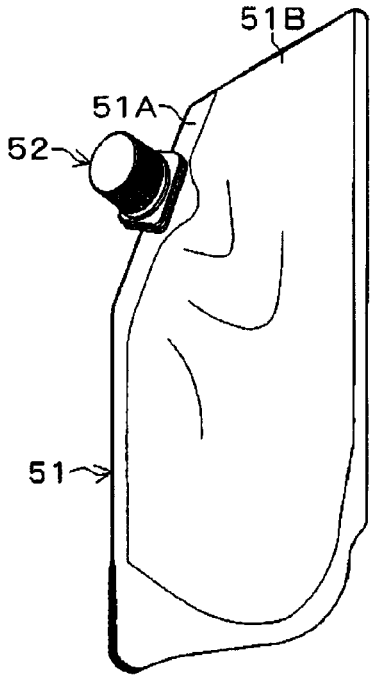
Figure 12:
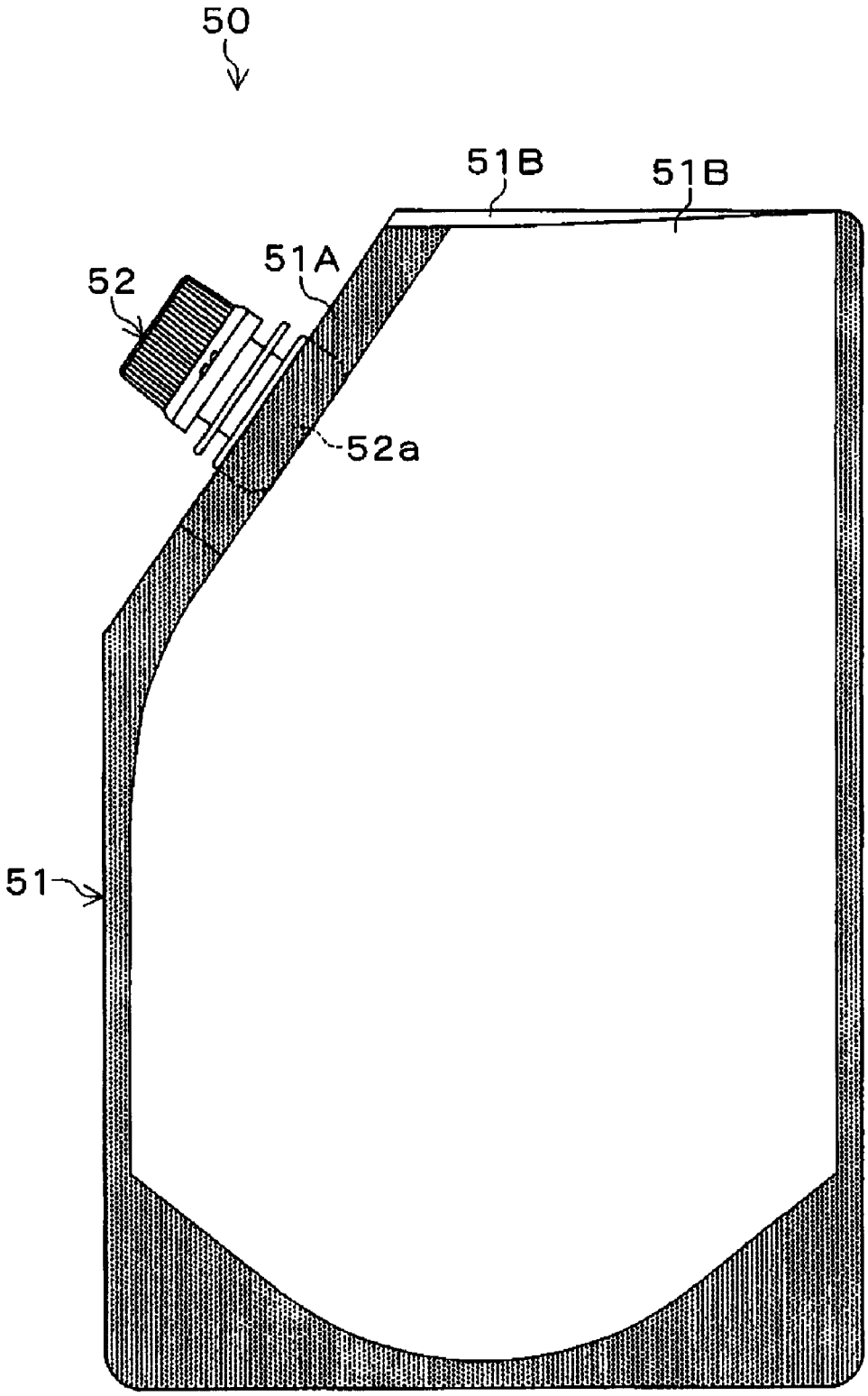
Fig. 12 PRIOR ART
FIG. 12 is a side view for explaining problems associated with the prior art spout pouch container.

To improve the openability of the filling port during the filling of the content, as shown in FIG. 8, non-sealing portions are desirably provided on an upper end of the spout attachment edge portion 10A and on an upper end of the opposite side edge. However, when the filling port defining edge portion 10B is heat-sealed after the filling of the content, sealing portions should be significantly overlapped to ensure sufficient sealing.

In the embodiment described above, the spot-seal portion is preliminarily formed in the region around the boundary between the portions of the sheets later serving as the spout attachment edge portion 10A and the filling port defining edge portion 10B during the production of the pouch 10, but this arrangement is not limitative. The formation of the spot-seal portion in the region around the boundary between the spout attachment edge portion and the filling port defining edge portion may be carried out after a pouch including an unsealed spout attachment edge portion and an unsealed filling port defining edge portion is produced.

The shape and size of the spot-seal portion PS are not particularly limited. However, an excessively great size of the spot-seal portion PS is not preferred, because the size of an opening into which the spout 20 is inserted and the size of the filling port through which the content is filled are reduced. The spot-seal portion PS may have a round shape, but preferably has a shape, as shown in FIG. 3, such that an edge PSE1 thereof on the side of the spout attachment edge portion 10A is generally parallel to an upper edge SSE1 of one side edge seal portion of the exterior sheets 11, 12 generally perpendicular to the spout attachment edge portion 10A and an edge PSE2 thereof on the side of the filling port defining edge portion 10B is generally parallel to an inner edge SSE2 of the other side edge seal portion of the exterior sheets 11, 12 generally perpendicular to the filling port defining edge portion 10B. Where the edges PSE1, PSE2 of the spot-seal portion PS are inclined inward of the pouch 10 so as to widen the opening for the insertion of the spout 20 and the filling port for the filling of the content, the openability of the spout attachment edge portion 10A and the filling port defining edge portion 10B is reduced.

In the embodiment described above, the pouch 10 of the spout pouch container 1 has the bottom gusset portion, but this arrangement is not limitative. For example, the present invention is also applicable to a flat pouch having no gusset portion.

INDUSTRIAL APPLICABILITY

The present invention is applicable to a spout pouch container of a type which includes a spout heat-sealed to a spout attachment edge portion and is adapted to fill content not from the spout but from a filling port adjacent to the spout attachment edge portion.

The invention claimed is:

1. A pouch for production of a spout pouch container, the pouch comprising:

a spout attachment edge portion;

a filling port defining edge portion provided adjacent to the spout attachment edge portion and defining a filling port through which content is filled in the pouch; and a sealed spot-seal portion provided in a region around a boundary between the spout attachment edge portion and the filling port defining edge portion;

wherein the filling port defining edge portion is not sealed, wherein the spout attachment edge portion is not sealed, wherein a spout is not attached to the filling port defining edge portion, wherein the spout attachment edge portion is configured to have first portions that are heat-sealed to each other when the spout is held and heat-sealed in the spout attachment edge portion, and also has second portions that are heat-sealed to the spout, wherein a first edge of said spot-seal portion is generally perpendicular to said spout attachment edge portion and a second edge of said spot-seal portion is generally perpendicular to said filling port defining edge portion and wherein said first edge of said spot-seal portion and said second edge of said spot-seal portion are joined together.

2. A pouch for production of a spout pouch container, the pouch comprising:

a spout attachment edge portion;

a filling port defining edge portion provided adjacent to the spout attachment edge portion and defining a filling port through which content is filled in the pouch;

a sealed spot-seal portion provided in a region around a boundary between the spout attachment edge portion and a filling port defining edge portion;

wherein said sealed spot-seal portion is located outside the spout attachment edge portion and the filling port defining edge portion, wherein a spout is not attached to the filling port defining edge portion, wherein a first edge of said spot-seal portion is generally perpendicular to said spout attachment edge portion and a second edge of said spot-seal portion is generally perpendicular to said filling port defining edge portion, and wherein said first edge of said spot-seal portion and said second edge of said spot-seal portion are joined together.

3. The production method for a spout pouch container of claim 1, wherein the sealed spot-seal portion is of a triangular shape.

* * * * *